United States Patent [19]

Ward

[11] 4,166,603

[45] Sep. 4, 1979

[54] SCAFFOLD FOR POURED CONCRETE WALLS AND FORMS

[76] Inventor: Edward B. Ward, 820 Winchester, Kansas City, Mo. 64125

[21] Appl. No.: 882,102

[22] Filed: Feb. 28, 1978

[51] Int. Cl.[2] ..... E04G 11/28

[52] U.S. Cl. ..... 249/20; 249/40; 249/210

[58] Field of Search ..... 249/20–22, 249/210, 35, 40, 41, 44, 45, 91, 190–191, 213, 214, 216–218; 248/235; 182/82, 87

[56] References Cited

U.S. PATENT DOCUMENTS

| | | | |
|---|---|---|---|
| 1,526,776 | 2/1925 | Dalidz | 249/40 |
| 2,882,101 | 4/1959 | Michalak et al. | 182/82 |
| 3,044,573 | 7/1962 | Jackson | 182/87 |
| 3,199,827 | 8/1965 | Terry | 249/41 |
| 3,664,630 | 5/1972 | Maynen et al. | 249/112 |
| 3,899,155 | 8/1975 | Ward | 249/189 |
| 3,995,825 | 12/1976 | Ward et al. | 249/41 |

FOREIGN PATENT DOCUMENTS

| | | | |
|---|---|---|---|
| 2060486 | 6/1971 | Fed. Rep. of Germany | 182/82 |

*Primary Examiner*—John McQuade

*Attorney, Agent, or Firm*—Fishburn, Gold & Litman

[57] ABSTRACT

A scaffold is provided for poured concrete walls and forms which have a plurality of prefabricated form panels interconnected in an end-to-end fashion and are generally arranged in two opposing rows. Vertically spaced tie bars extend transversely between the opposing rows of form panels at each juncture thereof, and laterally interconnect the same. The scaffold comprises a rigid support arm member having an inward end detachably connected with one of the tie bars. The support arm extends substantially horizontally from the form panels and the outward end thereof is connected with the outer end of an angle brace member. The angle brace is positioned at an acute angle to the support arm, and includes an inward end which is shaped for detachable connection with another one of the tie bars for selectively retaining the support arm in a generally, substantially horizontal orientation.

14 Claims, 7 Drawing Figures

SCAFFOLD FOR POURED CONCRETE WALLS AND FORMS

BACKGROUND OF THE INVENTION

This invention relates to scaffolds, and in particular to scaffolds for poured concrete walls and forms. The present scaffold arrangement is particularly adapted for use in conjunction with prefabricated poured concrete wall forms which are interconnected by a plurality of tie bars, such as disclosed in my U.S. Pat. No. 3,899,155. In the construction of poured concrete walls, the prefabricated poured form panels are carefully aligned and interconnected so as to form a straight and plumb wall cavity. Wire reinforcing mesh is generally placed along the longitudinal center of the wall cavity to support and strengthen the wall. It is often necessary to access the upper, open end of the wall cavity, for purposes such as directing unsolidified cement between the form panels, adjusting reinforcing materials between the form panels, interconnecting additional form panels to the top surface of the lower form panels, and the like. However, if the set forms are inadvertently jarred, or if excessive forces are placed thereon, such as by scaffolding, workmen, or the like, the form may be moved from its preset position to a laterally inclined position wherein it assumes the shape of a parallelogram, thereby resulting in a poorly constructed building wall. Although external bracing may be provided to support the form panels, the construction of such bracing is quite time consuming in that it must be fabricated and ultimately removed, and further forms obstructions about the base of the form panels, so as to hinder material flow and create a safety hazard for the workmen.

As previously noted, to achieve the greatest structural strength, wire mesh is typically disposed along the longitudinal center of the wall in a substantially flat plane which is parallel with the interior surface of both rows of form panels. Should the form panels move from their aligned, preset position, as noted above, the wire mesh will be urged into an off-center relationship with respect to the form panel, thereby considerably reducing the strength of the wall.

The principal objects of the present invention are: to provide a scaffold for concrete wall forms which will support substantial weight without distorting the wall forms from their prealigned position; to provide such a scaffold which is capable of securingly supporting substantial weight without requiring external bracing; to provide such a scaffold which is easily and quickly attachable to both poured concrete walls and forms; to provide such a scaffold having a rigid support arm with means for connecting horizontal planks thereto for supporting objects and workers; to provide such a scaffold wherein the rigid support arm includes an end channel member for supporting a railing member above the planks; to provide such a scaffold having an angle brace member connected with an extending tie bar for supporting the rigid support arm in a substantial horizontal position; to provide such a scaffold which is adapted for attachment to the tie bars of a poured concrete wall to facilitate assembling additional form panels for multiple-lift buildings; to provide such a scaffold having an apertured top plate for inter-connecting and aligning the additional form panels; to provide such a scaffold having a depending riser member which includes at least two transverse apertures therethrough, whereby the scaffold is adjustable for connection to both the wall and the form; to provide such a scaffold wherein a pair of elongate rods interconnect the tie bars for secure support; and to provide such a scaffold which is economical to manufacture, efficient in use, durable, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include exemplary embodiments of the present invention and illustrate various objects and features thereof.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 5:
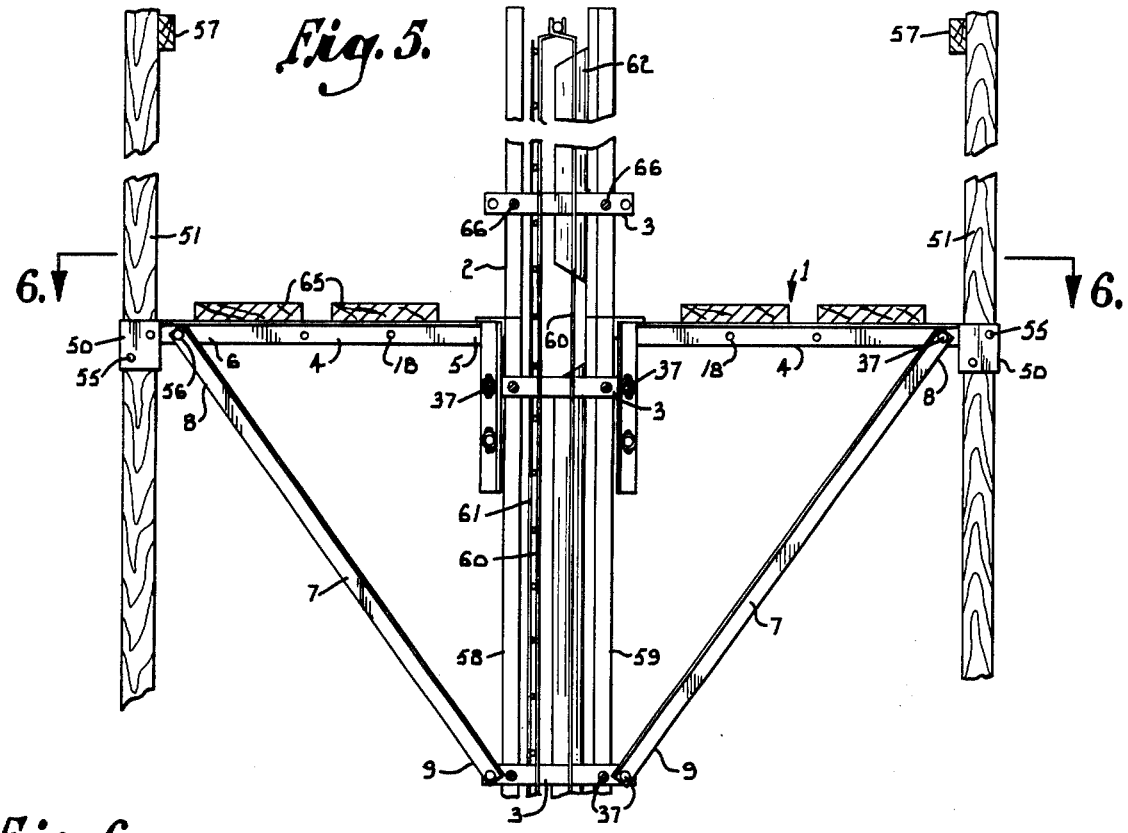
FIG. 5 is a side elevational view of the scaffold member in combination with a form for poured concrete walls.

For purposes of description herein, the terms "upper", "lower", "right", "left", "rear", "front", "vertical", "horizontal" and derivatives thereof, shall relate to the scaffold as oreinted in FIG. 5, however, it is to be understood, that the scaffold may assume virtually any alternative orientation, except where expressly specified to the contrary.

Figure 6:
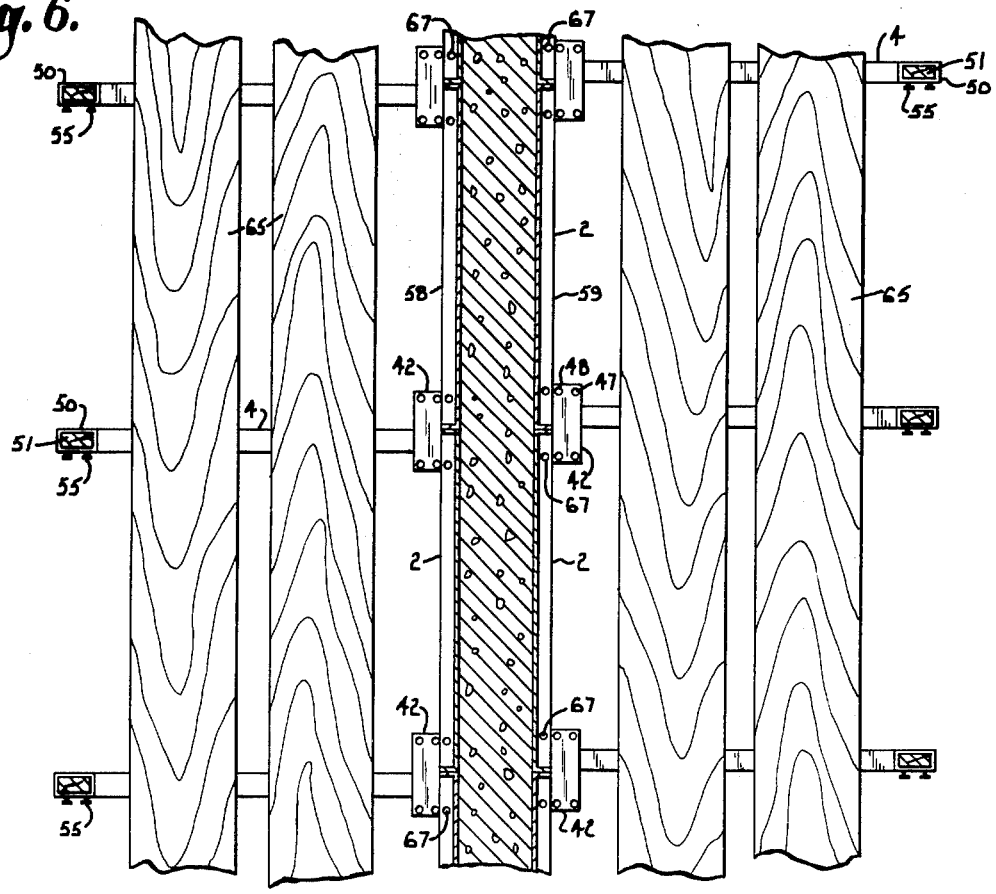
FIG. 6 is a top plan view of the scaffold member interconnected to the form.

The reference numeral 1 generally designates a scaffold for poured concrete walls and forms which embodies the present invention, and includes a plurality of prefabricated form panels 2 (FIGS. 5 and 6) interconnected in an end-to-end fashion and generally arranged in two opposing rows. Vertically spaced form ties 3 extend transversely between the opposing rows of form panels at each juncture thereof, and laterally interconnect the same. The scaffold 1 comprises a rigid support arm 4 having an inward end 5 detachably connected with one of the tie bars 3. The support arm 4 extends substantially horizontally from the form panels 2, and the outward end 6 thereof is connected with an angle brace 7 at the outer end 8 thereof. The angle brace 7 is positioned at an acute angle to the support arm 4, and includes an inward end 9, which is shaped for detachable connection with another one of the tie bars 3 for selectively and securely retaining the support arm 4 in a generally, substantially horizontal orientation.

Figure 1:
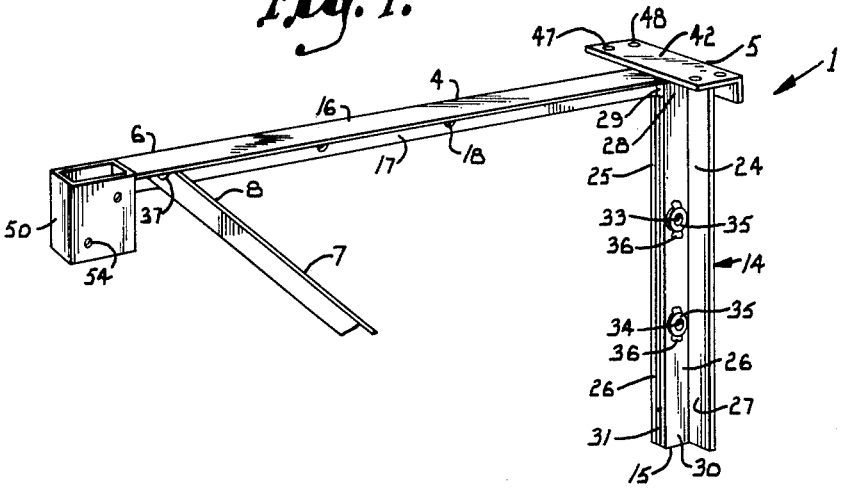
FIG. 1 is a perspective view of a scaffold member embodying the present invention.
Figure 2:
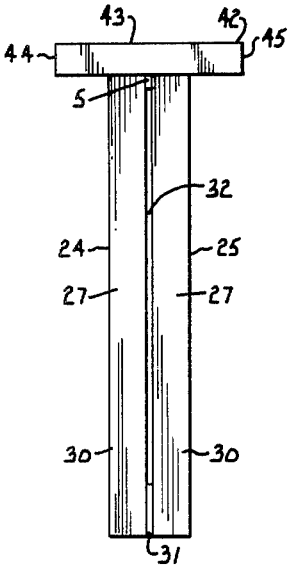
FIG. 2 is a rear elevational view of the scaffold member.
Figure 3:
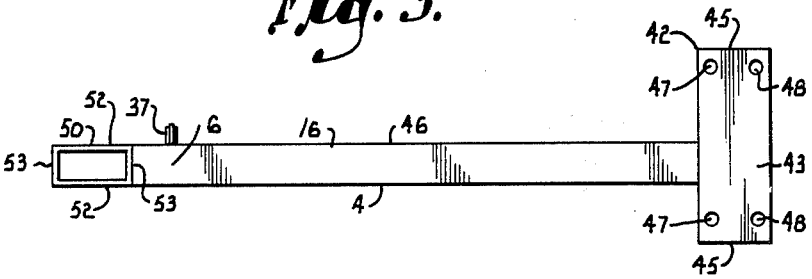
FIG. 3 is a top plan view of the scaffold member.
Figure 4:
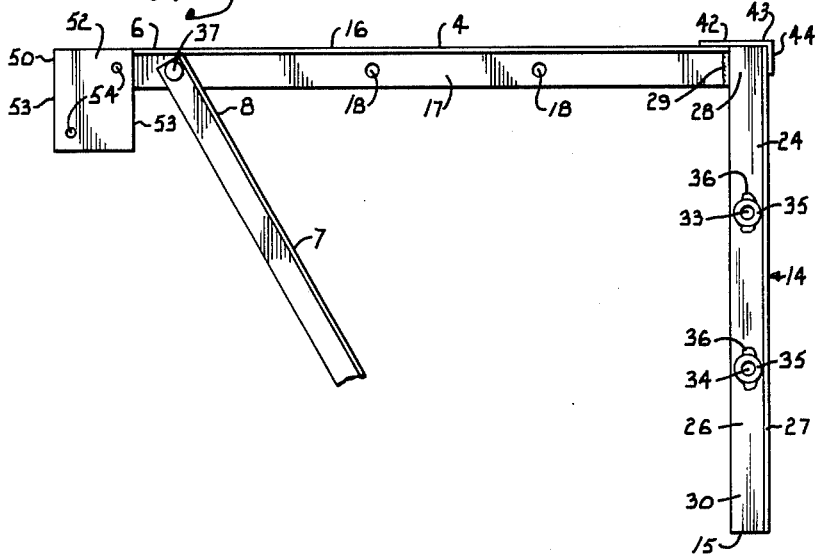
FIG. 4 is a side elevational view of the scaffold member.

The illustrated support arm 4 (FIGS. 1–4) includes an extension or riser member 14 which is fixedly attached to and depends vertically from the inner end 5 of the support arm. In this example, the support arm 4 is constructed of an L-shaped member in the nature of an angle shape, having a free end 15, an upper flange 16 disposed in a substantially horizontal plane, and a depending perpendicularly oriented flange 17. As best illustrated in FIG. 4, the lower flange 17 is provided with a plurality of transversely oriented apertures 18 therethrough which are spaced apart a predetermined distance and adapted to attach the angle brace member 7 thereto. At the inward end 5 of the support arm 4, the upper flange 16 is severed from the lower flange 17 and removed, forming a flat rectangularly shaped portion on the flange 17 for connecting the same rigidly to the riser 14 as hereinafter described in detail.

The illustrated riser 14 comprises a pair of L-shaped channels or angle iron segments 24 and 25 having one flange 26 thereof opposingly aligned and interconnected. The remaining flange 27 of each of the channel segments 24 and 25 extends rearwardly in a mutually opposing and outward fashion. The upper ends 28 of the channel segments 24 and 25 are positioned on opposing sides of the support arm lower flange 17 and are attached thereto by means such as a weld 29. The channel segments extend substantially perpendicularly from the arm and the lower ends 30 thereof are separated by a spacer member 31 and are fixedly interconnected by means such as a suitable fastener, welding, or the like. The thickness of the spacer 31 is substantially coextensive with the thickness of the support arm lower flange 17, whereby a rectangularly shaped slot or aperture 32 is formed between the opposing flanges of the channels 24 and 25. The slot 32 is adapted to receive a tie bar 3 therethrough to facilitate attaching the scaffold to concrete walls and forms. The inner flanges 26 of the channel members 24 and 25 each includes mutually aligned and spaced apart apertures 33 and 34 which are adapted to receive a retaining pin therethrough for connecting the riser 14 to the associated form tie. In this example, each of the channel members 24 and 25 and each of the apertures therein 33 and 34 is provided with a bushing 35 rigidly fixed to the flange member by means such as the illustrated spot weld 36, and is positioned about the aperture to facilitate the insertion and removal of the mating retainer pin 37. The illustrated bushings 35 are attached to the exterior surface of the associated channel member and provide quick and easy connection of the scaffold to the forms and walls.

A top plate 42 is connected with the inner end 5 of the support arm 4, and extends laterally thereof for engaging the wall and stabilizing the scaffold against horizontal pivoting. The illustrated top plate 42 is L-shaped and includes an upper flange 43 and an integrally connected bottom flange 44 which depends perpendicularly therefrom. The top and bottom top plate flanges 43 and 44 are fitted snugly and abuttingly against the support arm upper flange 16 and adjacent upper end of the riser flange members 24 and 25, and the outside surface of each of the flanges 27 respectively. The top plate includes end edges 45 which extend opposingly and outwardly of the arm 4, and are substantially centered about the inside edge 46 (FIG. 3) thereof. Two pairs of vertically oriented apertures 47 and 48 are provided in the top plate 42, are spaced apart a predetermined distance, and are adapted for aligning and interconnecting adjacent form panels associated therewith, as described hereinafter.

A bracket 50 is rigidly attached to the outer end 6 of the support arm 4 and is shaped for receiving and retaining a vertical scaffolding support 51 (FIG. 5) therein. The illustrated bracket 50 has interconnected side walls 52 and end walls 53 with a substantially rectangular transverse cross-sectional shape. The bracket 50 has a width substantially coextensive with the width of upper flange 16, and depends below the lower edge of the support arm lower flange 17 to form a sleeve in which the scaffold support 51 may be securely anchored. The scaffold support 51 may be attached to the bracket 50 in any suitable manner, and in the illustrated example, a pair of transversely oriented apertures 54 are provided through both of the bracket side walls 52 in an aligned fashion and are adapted to receive elongate fasteners, such as double headed nails 55 therein to detachably interconnect the scaffold support 51 with the support arm 4.

The angle brace 7 is a rigid structure and retains the support arm 4 in a generally, substantially horizontal orientation. In the illustrated example, the angle brace 7 is constructed of an L-shaped channel and includes a transverse aperture 56 positioned through each end thereof for receiving a retaining pin therein and attaching the same to the support arm 4 and tie bar 3 respectively. The ends of the angle brace 7 are pivotally attached to the support arm and tie bar whereby the scaffold may be easily removed from the form after the concrete has cured and reset on the cured wall.

As best illustrated in FIG. 5, the scaffold 1 is particularly adapted for use in conjunction with interconnected form ties and form panel liners such as described in my copending U.S. patent application Ser. No. 846,154, filed Oct. 27, 1977. In the structure illustrated in FIG. 5, a plurality of vertically spaced tie bars 3 interconnect the opposing form panels 58 and 59. The tie bars are interconnected by a pair of mutually parallel and spaced elongate rods 60 which are positioned perpendicularly to each of the tie bars 3 and are fixedly attached thereto to rigidly align and hold the form panels in a plumb and straight position. For purposes of description herein, it shall be assumed that the interior side of the wall is adjacent form panel 59, and the exterior side of the wall is adjacent the form panel 58. The exterior rod 60 is connected with reinforcing mesh 61 and accurately and positively positions the mesh along a central, predetermined plane between the form panels 58 and 59 for improved wall strength, reduced material usage and labor efficiency. Further, a form liner 62 is connected with the interior form panel 59 and is adapted to form the concrete wall and insulate the same. The illustrated liner has a second side thereof in spaced relation to the exterior form panel, and includes a marginal edge portion and a medial portion projecting outwardly therefrom, forming contiguous post and beam portions of the form. The interior rod 60 is preferably positioned centrally in the post portion of the form.

In use, the inside form panels 59 are positioned in a side-by-side manner on a base support, such as a footing, slab, or the like (not shown). The ties 3 are then placed between adjacent inside panels and are connected therewith by means such as the illustrated retaining pin mechanisms 37. The form liners 62 are then located between the tie bars 3 with the interior surface of the liner 62 abutting the interior surface of the inside form panel 59. Flat sections of reinforcing wire mesh 61 are then positioned over each of the tie bars, threading the same through the wire mesh apertures, and the mesh is positioned adjacent to and abutting the outside rod 60 and fixedly attached thereto. The outside form panels 58 are then positioned in a side-by-side manner a predetermined distance from the inside panels, and are interconnected therewith by fastening the outer end of the tie bars 3 in the outside form panels with retaining pin mechanisms 37. If the operator desires to access the upper opening of the wall forms before the wall is poured therein, he attaches the scaffold 1 to one or both sides of the form. In the structure illustrated in FIGS. 5 and 6, the scaffold is attached to both sides of the form, and is connected thereto by positioning the support arm 4 adjacent the upper edge of the form at the associated form tie 3. The outside end of the tie bar is then inserted or threaded into the slot 32 between the riser channels 24 and 25, and a retainer mechanism is inserted through the appropriate aperture 33 or 34 and the aligned aperture in the tie bar. The width of the slot 32 is substantially coextensive with the width of the tie bar 3, and thereby resists rotation of the scaffold in a vertical plane. The scaffold is connected with either aperture 33 or 34 in accordance with the prescribed use. The outer surface of the top plate bottom flange 44 abuts the adjacent form panels, and assists in preventing rotation of the scaffold in a horizontal plane. The lower end 9 of the angle brace 7 is then connected with a second tie bar 3 which is spaced apart from the tie bar on which the scaffold riser 14 is connected. The distance between the two tie bars is preferably substantial to reduce the stress on the angle brace, and in the illustrated example is in the nature of six (6) feet. The outer end 8 of the angle brace 7 is then raised into alignment with one of the apertures in the support arm lower flange 17, such as aperture 18, and is connected therewith by a retainer pin 37. A triangular construction is formed by the angle brace 7, support arm 4, and form ties 3 which is very sturdy and capable of supporting a great deal of weight thereon. The support arm 4 is preferably connected to the form at each juncture of the form panel and the support arms 4 are interconnected by longitudinally extended supports such as the illustrated planks 65. Vertically extending scaffold supports 51 are then inserted through the end bracket 50 and attached thereto by means such as fasteners 55. The ends of the scaffold support 51 preferably extend in opposing directions and are similarly connected with scaffold structures on upper and lower floor segments of the wall. Horizontally extending rail members 57 may be fastened to the vertical scaffold supports 51 to provide additional rigidity and safety.

Figure 7:
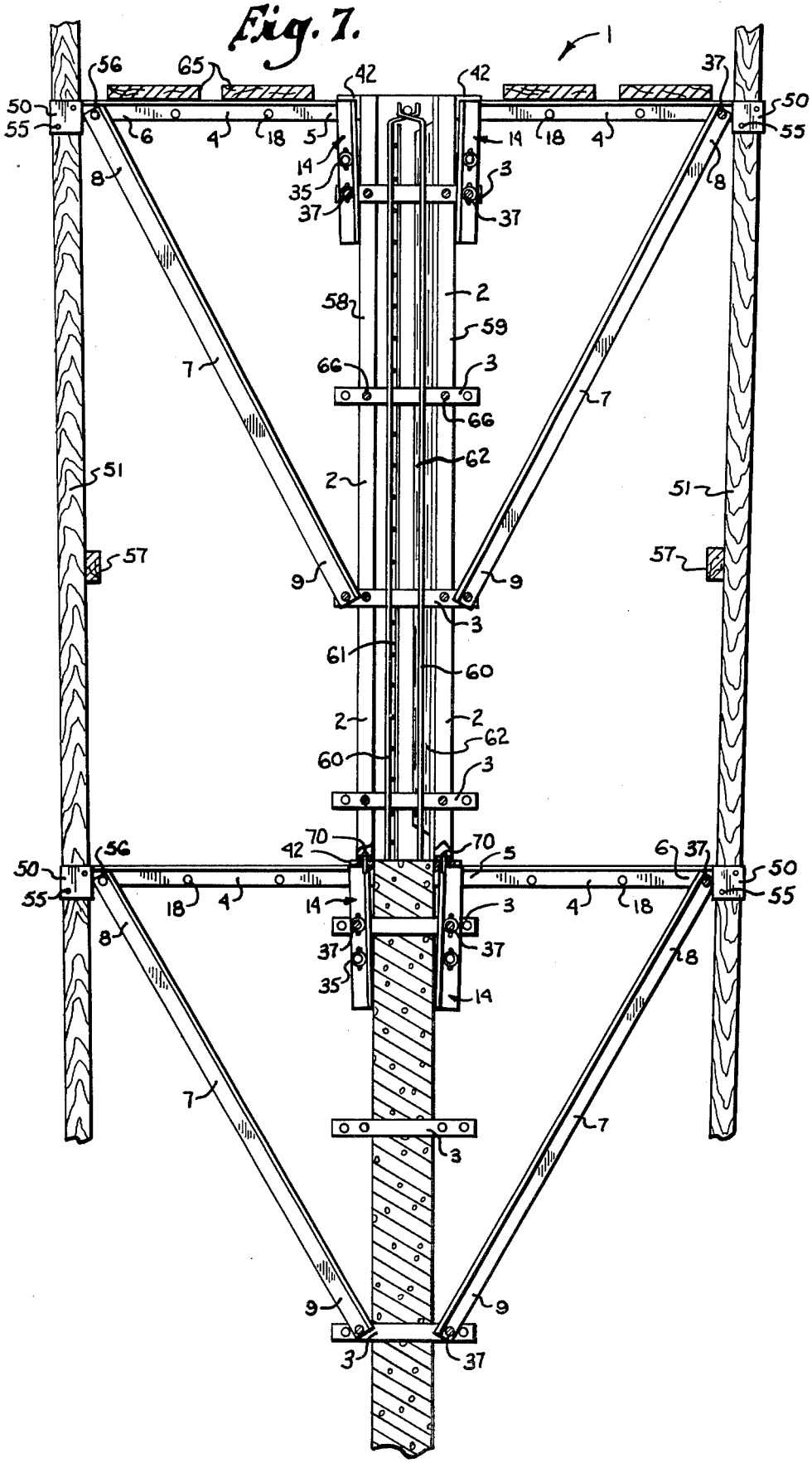
FIG. 7 is a side elevational view of a plurality of scaffold members in combination with a form and a cured wall.

Unsolidified concrete is then poured between the opposing form panels, and the same is cured to a hardened or solidified state. If the user desires to remove the form panels overlying the cured wall, he first removes the scaffolding by extracting the retaining pins 37 which connect the riser 14 to the upper tie bar and the lower end 9 of the angle brace 7 to the lower tie bar. The retainer pins interconnecting the form panels with the form ties are then removed, and the form panels are pulled from the wall. As best illustrated in FIG. 7, the scaffold may be reset on the cured wall by simply connecting the scaffold risers with the inside pair of apertures 66 in the tie bar. The scaffold top plate 42 then abuts and is supported by the exterior surface of the cured wall. The lower end 9 of the angle brace 7 is then reconnected with the lower form tie by attaching the same through the inside bar apertures 66. Form panels to construct the next lift or vertical wall section may then be placed upon the scaffold top plate 42 and supported thereby. Each of the form panels includes a pair of vertical apertures 67 which mate with the top panel apertures 47 and 48, whereby retaining pins 70 may be inserted vertically through the apertures to align the second lift form panels. In the illustrated arrangement, the retaining pins 70 are received in the inside apertures 47 of the top plate 43 whereby the wall extends upwardly directly from the lower lift, and is of substantially the same width. The upper forms may be aligned in the outer plate apertures 48 to achieve an offset or enlarged wall thickness, in which case, the end edges of the liners 62 seal the wall cavity and retain unsolidified concrete therein.

The top plate 42 of the scaffold bracket is preferably positioned substantially flush with the upper surface of the wall and/or form panels. The apertures 33 and 34 in the riser member 14 permit the user to adjust the scaffold bracket to this flush relationship with the wall for form panels of various heights, such as for conventional 8 foot walls, and 7 foot, 8 inch walls.

It is to be understood that while I have illustrated and described certain forms of my invention, it is not to be limited to the specific forms or arrangement of parts herein described and shown.

What I claim and desire to secure by Letters Patent is:

1. A scaffold for poured concrete walls having at least two vertically spaced rectangular tie bars projecting laterally therefrom, said scaffold comprising:

(a) a rigid support arm having a first end, and a second end shaped for detachable connection with one of said tie bars; said support arm second end including first and second opposing flanges spaced apart a distance substantially commensurate with the thickness of said tie bars, and forming a rectangularly shaped slot therebetween to receive one of said tie bars therein for securely attaching the support arm to the tie bar and stabilizing the scaffold against pivoting; said support arm being adapted for extending horizontally from said wall and supporting a weight thereon;

(b) an angle brace having a first end thereof connected with said support arm first end, and a second end adapted for detachable connection with another one of said tie bars; said angle brace being positioned at an acute angle with respect to said support arm, and retaining the same in a generally, substantially horizontal orientation.

2. A scaffold as set forth in claim 1 wherein:

(a) said support arm second end includes a riser member depending vertically therefrom and having one end fixedly attached thereto; said riser member including a free end spaced apart from the second end of said support arm and being adapted for detachable connection with said one tie bar.

3. A scaffold as set forth in claim 1 including:

(a) a top-plate connected with said support arm second end and extending laterally thereof for engaging said wall and stabilizing said scaffold against horizontal pivoting.

4. A scaffold as set forth in claim 1 wherein:

(a) said support arm second end and said angle brace second end each include a transverse aperture therethrough shaped for receiving a locking pin therein.

5. A scaffold as set forth in claim 2 including:

(a) a top plate connected with said support arm second end and extending laterally thereof for engaging said wall and stabilizing said scaffold against horizontal pivoting;

(b) a channel member connected with said support arm first end and defining a normally vertically oriented cavity adapted for receiving vertical railing supports therein.

6. A scaffold as set forth in claim 5 wherein:

(a) said top plate includes at least two transverse, spaced apart apertures therethrough for aligning and interconnecting adjacent form panels associated therewith.

7. A scaffold as set forth in claim 6 wherein:

(a) said riser member includes two transverse and spaced apart apertures each being adapted to receive a form locking pin therethrough, said riser apertures being spaced apart a distance whereby said scaffold is adjustable for connection to said wall and to said form panels.

8. A scaffold as set forth in claim 1 wherein:

(a) said first and second support arm flanges each include a transverse aperture therethrough shaped for receiving a locking pin therein.

9. In a form for poured concrete walls having a plurality of prefabricated form panels interconnected end-to-end and arranged in at least two opposing rows, wherein adjacent form panels in said opposing rows are interconnected by a plurality of rectangular tie bars extending laterally between the adjacent panels and are detachably connected therewith, and at least two of said tie bars have end portions thereof extending outwardly of one side of the wall and include a retaining pin aperture disposed transversely therethrough; the improvement comprising a scaffold comprising:

(a) a rigid support arm having a first end, and a second end detachably connected with one of said tie bars having the extending end portion; said support arm extending horizontally from an associated one of said form panels, and being adapted for supporting a weight thereon;

(b) an angle brace having a first end thereof connected with said support arm adjacent the first end thereof, and a second end detachably connected with another one of said tie bars having the extending end portion; said angle brace being positioned at an acute angle with respect to the associated form panel, and retaining the support arm in a generally, substantially horizontal orientation; and (c) first and second locking pins respectively connecting said support arm second end and said angle brace second end with the extending end portion of said two tie bars.

10. A form as set forth in claim 9 including:

(a) an elongate rod positioned substantially perpendicularly to each of said tie bars and being fixedly attached thereto; said rod securely retaining said tie bars in alignment.

11. A form as set forth in claim 10 wherein:

(a) said elongate rod constitutes a first rod; and including (b) a second elongate rod positioned substantially parallel with and spaced apart from said first rod, and being fixedly connected with each of said tie bars.

12. A form as set forth in claim 11 including:

(a) a form liner positioned between said adjacent form panels having a first side thereof abutting and being laterally supported by an interior surface of one of said form panels; said liner having a second side thereof in spaced relation to the other form panel and including a marginal edge portion and a medial portion projecting outwardly therefrom forming contiguous post and beam portions of said form.

13. A form as set forth in claim 12 wherein:

(a) said second elongate rod is positioned centrally in the post portion of said form.

14. A form as set forth in claim 10 including:

(a) wire mesh positioned over each of said tie bars and adjacent to said rod; and (b) means fastening said wire mesh to said rod, whereby said wire mesh is retained centrally between said adjacent form panels in a substantially flat condition and a parallel relationship with said adjacent form panels.

* * * * *